US009422046B2

(12) United States Patent
Ito

(10) Patent No.: US 9,422,046 B2
(45) Date of Patent: Aug. 23, 2016

(54) BOAT PROPULSION DEVICE

(71) Applicant: YAMAHA HATSUDOKI KABUSHIKI KAISHA, Iwata-shi, Shizuoka (JP)

(72) Inventor: Yu Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 143 days.

(21) Appl. No.: 14/492,267

(22) Filed: Sep. 22, 2014

(65) Prior Publication Data

US 2015/0151825 A1 Jun. 4, 2015

(30) Foreign Application Priority Data

Nov. 29, 2013 (JP) ..... 2013-248486

(51) Int. Cl.
*B63H 20/32* (2006.01)
*F02M 35/16* (2006.01)
*F02B 61/04* (2006.01)

(52) U.S. Cl.
CPC ..... *B63H 20/32* (2013.01); *F02M 35/167* (2013.01); *B63H 2020/323* (2013.01); *F02B 61/045* (2013.01)

(58) Field of Classification Search
CPC ..... B63H 20/32; B63H 2020/323
USPC ..... 440/76, 77; 123/198 E
See application file for complete search history.

(56) References Cited

U.S. PATENT DOCUMENTS 5,080,618 A * 1/1992 Dunham ..... F02B 61/045 440/77
5,120,248 A 6/1992 Daleiden et al.
7,247,064 B2 * 7/2007 Nakamura ..... B63H 20/32 440/77

FOREIGN PATENT DOCUMENTS

JP 06-040392 A 2/1994

* cited by examiner

*Primary Examiner* — S. Joseph Morano
*Assistant Examiner* — Andrew Polay
(74) *Attorney, Agent, or Firm* — Keating and Bennett, LLP

(57) ABSTRACT

A boat propulsion device includes an engine including a crankshaft extending in an up-and-down direction and a cowling accommodating the engine. The cowling includes a first cowling portion preferably made of resin, a second cowling and a coupling mechanism configured to couple the first cowling portion to the second cowling portion. The coupling mechanism includes a first lock portion and a second lock portion. The first lock portion is attached to the first cowling portion. The second lock portion is attached to the second cowling portion and locks with the first lock portion. The first cowling portion includes a cowling main body and a support portion. The support portion preferably has a plate shape. The support portion is erected on an inner surface of the cowling main body, supports the first lock portion, and includes a small thickness section and a large thickness section.

7 Claims, 8 Drawing Sheets

BOAT PROPULSION DEVICE

CROSS-REFERENCE TO RELATED APPLICATIONS

This application claims priority under 35 U.S.C. §119 to Japanese Patent Application No. 2013-248486, filed on Nov. 29, 2013. The entire disclosure of Japanese Patent Application No. 2013-248486 is hereby incorporated herein by reference.

BACKGROUND OF THE INVENTION

1. Field of the Invention

The present invention relates to a boat propulsion device.

2. Description of the Related Art

A boat propulsion device has been well-known as being equipped with a resin cowling assembly composed of a top cowling and a bottom cowling, and a coupling mechanism for coupling the top cowling and the bottom cowling (see Japan Laid-open Patent Application Publication No. JP-A-H06-40392). The coupling mechanism includes a cam driven portion and a cam block. The cam driven portion is attached to the top cowling, whereas the cam block is attached to the bottom cowling. The bottom cowling includes an attachment block disposed on the inner surface thereof. The attachment block supports the cam block (therefore, the attachment block will be hereinafter referred to as "a support portion"). The support portion is composed of a plurality of plate-shaped members. The plate-shaped members are uniformly formed with a small thickness in order to entirely form a joint section of the support portion to be joined to the bottom cowling with a small thickness. Thus, it is possible to prevent dents attributed to molding shrinkage of the support portion from being produced in the bottom cowling by thinly forming the joint section joined to the bottom cowling.

However, when the support portion is entirely formed with a small thickness, a drawback is created in that the strength of the support portion itself is inevitably degraded.

SUMMARY OF THE INVENTION

Preferred embodiments of the present invention have been conceived in view of the situation described above. A preferred embodiment of the present invention provides a boat propulsion device that reliably achieves the strength required for a support portion configured to support a coupling mechanism of a cowling and to prevent dents attributed to molding shrinkage.

A boat propulsion device according to a preferred embodiment includes an engine including a crankshaft extending in an up-and-down direction and a cowling accommodating the engine. The cowling includes a first cowling portion made of resin, a second cowling, and a coupling mechanism configured to couple the first cowling portion to the second cowling portion. The coupling mechanism includes a first lock portion and a second lock portion. The first lock portion is attached to the first cowling portion. The second lock portion is attached to the second cowling portion and locks with the first lock portion. The first cowling portion includes a cowling main body and a support portion. The support portion preferably has a plate shape. The support portion is erected on an inner surface of the cowling main body. The support portion supports the first lock portion. The support portion includes a small thickness section and a large thickness section. The small thickness section is connected with the inner surface. The large thickness section includes an attachment surface to which the first lock portion is attached. The large thickness section is continuous with the small thickness section. A thickness of the large thickness section is greater than a thickness of the small thickness section in a direction perpendicular or substantially perpendicular to the attachment surface.

According to preferred embodiments of the present invention disclosed herein, it is possible to provide a boat propulsion device that reliably achieves the strength required for a support portion configured to support a coupling mechanism of a cowling and to prevent dents attributed to molding shrinkage.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
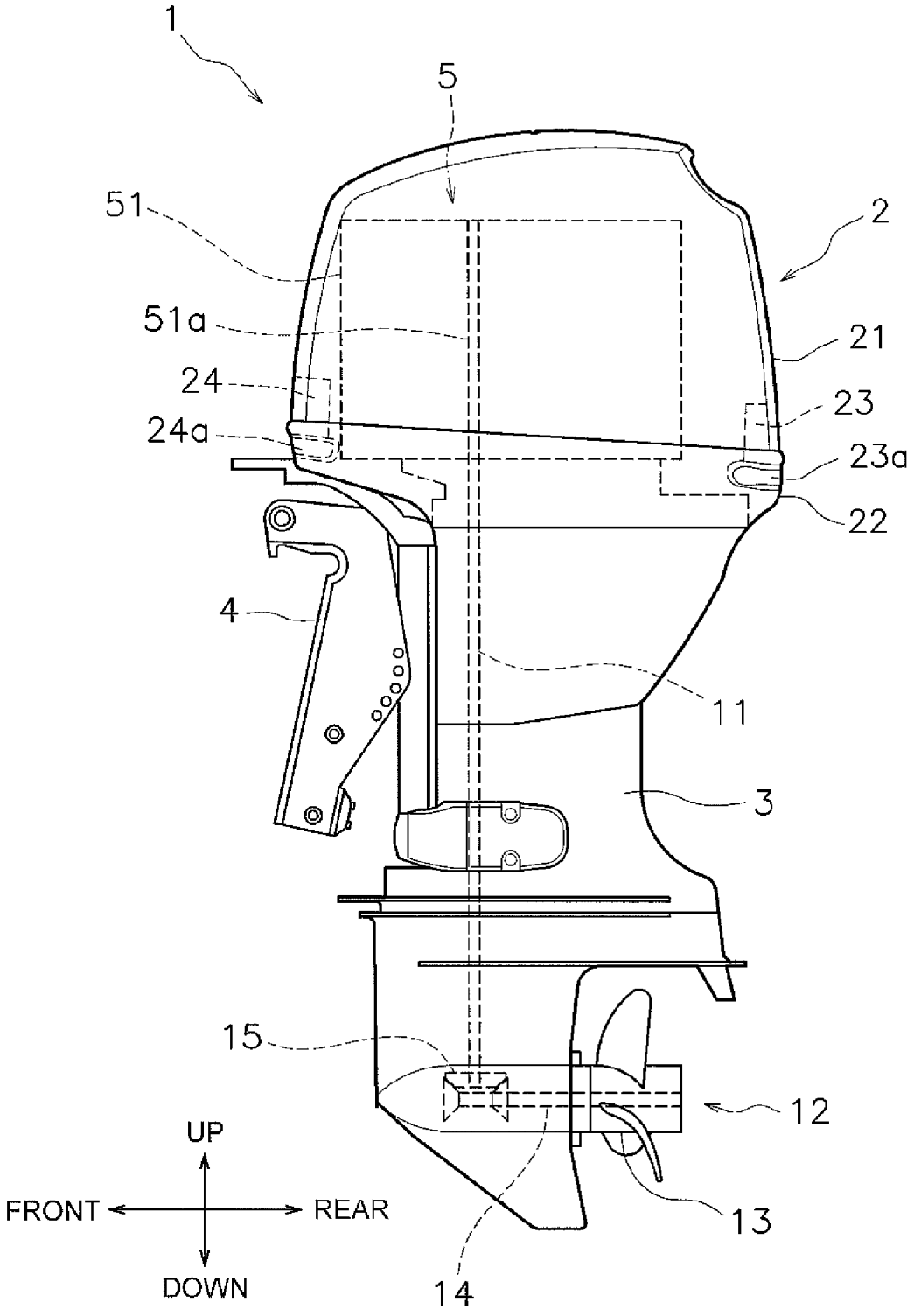
FIG. 1 is a side view of a boat propulsion device according to a preferred embodiment of the present invention.

With reference to the attached drawings, explanation will be hereinafter made for a boat propulsion device according to preferred embodiments of the present invention. FIG. 1 is a side view of a boat propulsion device 1 according to a preferred embodiment. The boat propulsion device 1 is preferably an outboard motor. The boat propulsion device 1 includes a cowling 2, a casing 3, a bracket 4, and an engine unit 5.

The cowling 2 accommodates the engine unit 5. The cowling 2 includes a top cowling portion 21 preferably made of resin, a bottom cowling portion 22 preferably made of metal, a first coupling mechanism 23, and a second coupling mechanism 24. The top cowling portion 21 is disposed on the bottom cowling portion 22. The top cowling portion 21 covers the top side and the lateral sides of the engine unit 5. For example, thermoplastic resin is preferably used as the resin material of which the top cowling portion 21 is made. The bottom cowling portion 22 covers the bottom side of the engine unit 5. A first recess 22*a* is provided in the rear end portion of the bottom cowling portion 22, whereas a second recess 22*b* is provided in the front end portion of the bottom cowling portion 22. For example, aluminum alloy or the like is preferably used as the metal material of which the bottom cowling portion 22 is made.

The first coupling mechanism 23 couples the rear end portion of the top cowling portion 21 and that of the bottom cowling portion 22. The first coupling mechanism 23 includes a first lock lever 23*a*. The first lock lever 23*a* is turnably attached to the bottom cowling portion 22. When the first lock lever 23*a* is pushed into the first recess 22*a*, the first coupling mechanism 23 is configured to couple the top cowling portion 21 and the bottom cowling portion 22. By contrast, when the first lock lever 23*a* is pulled out of the first recess 22*a*, coupling by the first coupling mechanism 23 is released. On the other hand, the second coupling mechanism 24 couples the front end portion of the top cowling portion 21 and that of the bottom cowling portion 22. The second coupling mechanism 24 includes a second lock lever 24*a*. The second lock lever 24*a* is turnably attached to the bottom cowling portion 22. When the second lock lever 24*a* is pushed into the second recess 22*b*, the second coupling mechanism 24 is configured to couple the top cowling portion 21 and the bottom cowling portion 22. By contrast, when the second lock lever 24*a* is pulled out of the second recess 22*b*, coupling by the second coupling mechanism 24 is released. It should be noted that explanation will be made below for the internal structures of the coupling mechanisms 23 and 24.

The casing 3 is disposed under the cowling 2. The boat propulsion device 1 is attached to a vessel body through the bracket 4. The engine unit 5 is disposed within the cowling 2. The engine unit 5 includes an engine 51. A drive shaft 11 is disposed within the casing 3. The drive shaft 11 extends within the casing 3 in the up-and-down direction. The drive shaft 11 is fixed to a crankshaft 51*a* extending within the engine 51 in the up-and-down direction. A propeller 12 is disposed in the lower portion of the casing 3. The propeller 12 is disposed under the engine 51. The propeller 12 includes a propeller boss 13. A propeller shaft 14 is disposed inside the propeller boss 13. The propeller shaft 14 is disposed along a back-and-forth direction. The propeller shaft 14 is coupled to the lower portion of the driveshaft 11 through a bevel gear 15.

In the boat propulsion device 1, a driving force generated by the engine 51 is transmitted to the propeller 12 through the drive shaft 11 and the propeller shaft 14. The propeller 12 is thus configured to be forwardly or reversely rotated. As a result, this rotation generates thrust to forwardly or backwardly propel the vessel body to which the boat propulsion device 1 is attached.

Figure 2:
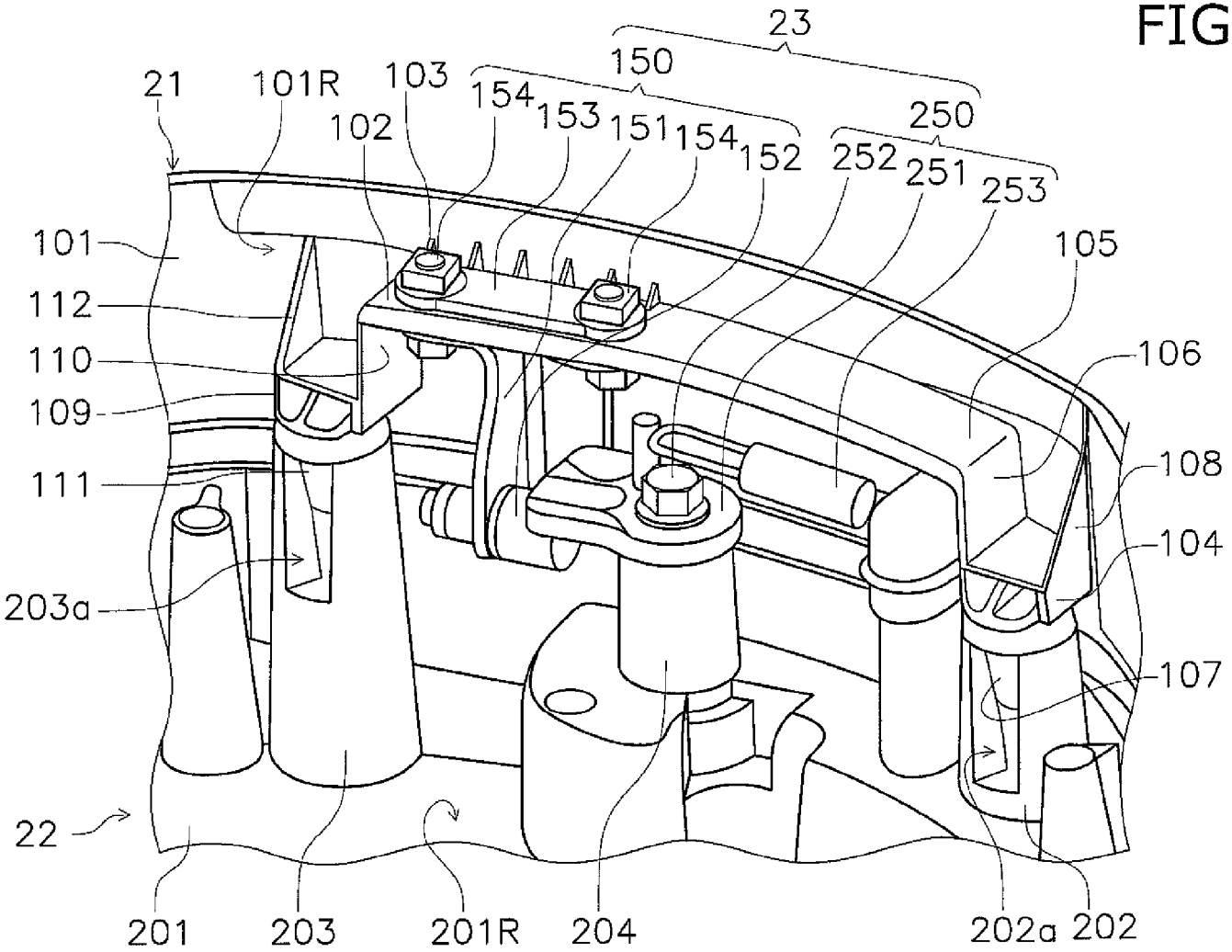
FIG. 2 is a perspective view of a support structure of a first coupling mechanism.
Figure 3:
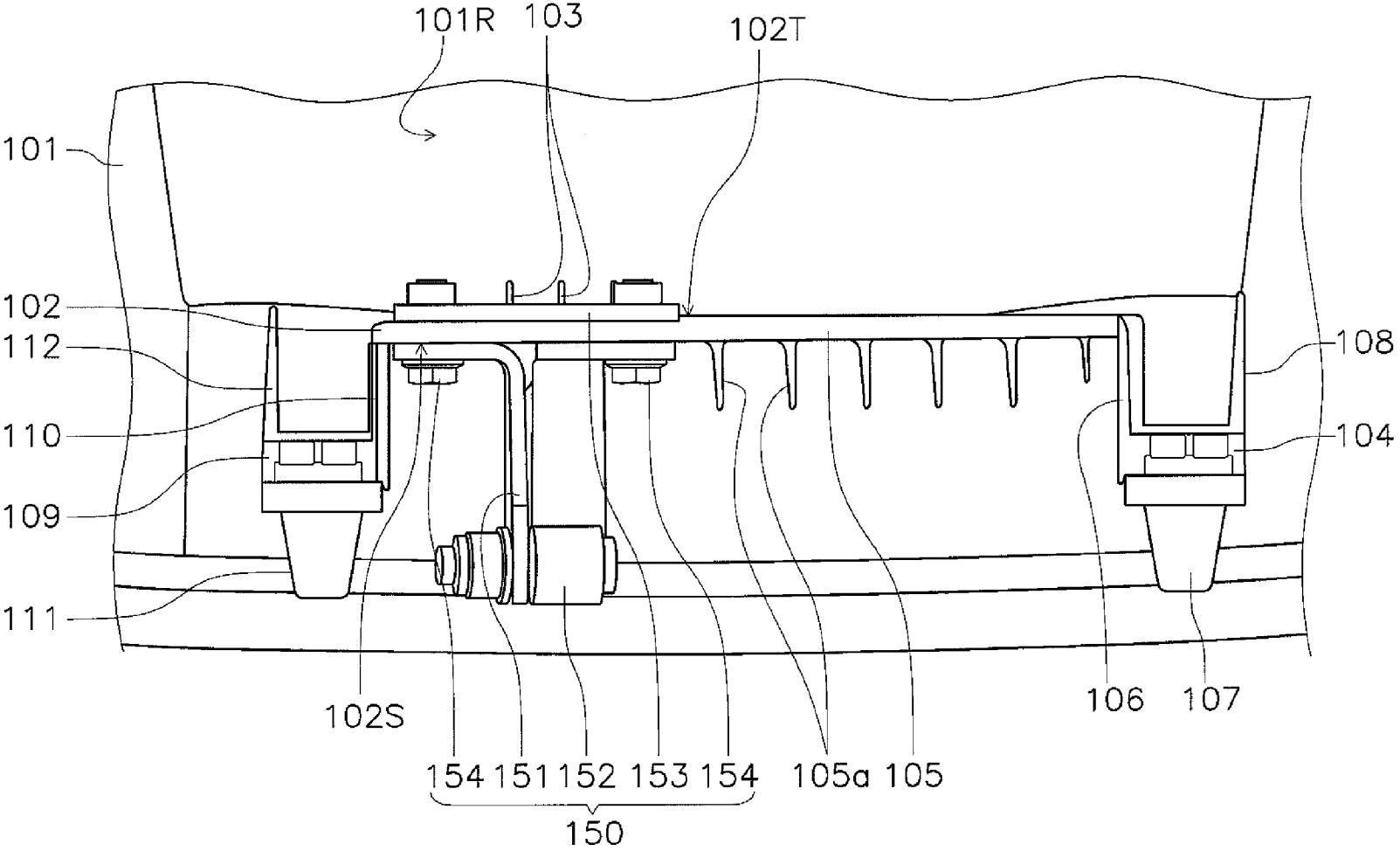
FIG. 3 is a side view of the support structure of the first coupling mechanism.

FIG. 2 is a perspective view of a support structure of the first coupling mechanism 23. FIG. 3 is a side view of the support structure of the first coupling mechanism 23. The support structure of the first coupling mechanism 23 and that of the second coupling mechanism 24 are preferably structurally identical to each other. Therefore, explanation will be hereinafter mainly made of the support structure of the first coupling mechanism 23.

The top cowling portion 21 includes a top cowling main body 101, a support portion 102, a plurality of rib portions 103, a first base portion 104, a reinforcement portion 105, a first side plate portion 106, a first convex portion 107 and a rib portion 108, a second base portion 109, a second side plate portion 110, and a second convex portion 111 and a rib portion 112.

The top cowling main body 101 preferably has a cup shape. The top cowling main body 101 includes an inner surface 101R. The support portion 102 is erected on the inner surface 101R. The support portion 102 preferably has a plate shape. The support portion 102 is disposed along the horizontal or substantially horizontal direction. The support portion 102 includes an attachment surface 102S and an opposite surface 102T. The attachment surface 102S and the opposite surface 102T are respectively principal surfaces of the plate-shaped support portion 102. The opposite surface 102T is disposed on the opposite side of the attachment surface 102S. The attachment surface 102S is the bottom surface of the support portion 102, whereas the opposite surface 102T is the top surface of the support portion 102. The plurality of rib portions 103 are erected on the inner surface 101R. The rib portions 103 are connected to the opposite surface 102T of the support portion 102. The rib portions 103 preferably have a triangular plate shape, for example. The rib portions 103 are disposed along the up-and-down direction. The rib portions 103 prevent the support portion 102 from being deflected up and down.

The first base portion 104 is erected on the inner surface 101R. The first base portion 104 is connected to the support portion 102 through the reinforcement portion 105 and the first side plate portion 106. The first base portion 104 preferably has a box shape, for example. The reinforcement portion 105 is erected on the inner surface 101R. The reinforcement portion 105 preferably has a plate shape. The reinforcement portion 105 is disposed along the horizontal or substantially horizontal direction so as to be continuous with the support portion 102. A plurality of rib portions 105*a* are connected to the reinforcement portion 105. The rib portions 105*a* are erected on the inner surface 101R. The rib portions 105*a* are connected to the bottom surface of the reinforcement portion 105. The rib portions 105*a* preferably have a triangular plate shape, for example. The rib portions 105*a* are disposed along the up-and-down direction. The rib portions 105*a* prevent the reinforcement portion 105 from being deflected up and down, while further preventing the support portion 102 from being deflected up and down. The first side plate portion 106 is erected on the inner surface 101R. The first side plate portion 106 preferably has a plate shape. The first side plate portion 106 is disposed along the up-and-down direction so as to be continuous with the reinforcement portion 105 and the first base portion 104.

The first convex portion 107 is attached to the first base portion 104. The first convex portion 107 is disposed so as to downwardly protrude from the bottom surface of the first base portion 104. The first convex portion 107 is preferably made of an elastic member (e.g., rubber). The rib portion 108 is erected on the inner surface 101R. The rib portion 108 is connected to the top surface of the first base portion 104. The rib portion 108 preferably has a triangular plate shape, for example. In a direction perpendicular to the inner surface 101R, the height of the rib portion 108 is gradually reduced with an increasing distance from the first base portion 104. In other words, the height of the upper end of the rib portion 108 is lower than that of the lower end of the rib portion 108 in the direction perpendicular to the inner surface 101R.

The second base portion 109 is erected on the inner surface 101R. The second base portion 109 is connected to the support portion 102 through the second side plate portion 110. The second base portion 109 preferably has a box shape, for example. The second side plate portion 110 is erected on the inner surface 101R. The second side plate portion 110 preferably has a plate shape. The second side plate portion is disposed along the up-and-down direction so as to be continuous with the support portion 102 and the second base portion 109.

The second convex portion 111 is attached to the second base portion 109. The second convex portion 111 is disposed so as to downwardly protrude from the bottom surface of the second base portion 109. The second convex portion 111 is preferably made of an elastic member (e.g., rubber). The rib portion 112 is erected on the inner surface 101R. The rib portion 112 is connected to the top surface of the second base portion 109. The rib portion 112 preferably has a triangular plate shape, for example. In a direction perpendicular to the inner surface 101R, the height of the rib portion 112 is gradually reduced with an increasing distance away from the second base portion 109. In other words, the height of the upper end of the rib portion 108 is lower than that of the lower end of the rib portion 108 in the direction perpendicular to the inner surface 101R.

The bottom cowling portion 22 includes a bottom cowling main body 201, a first boss portion 202, a second boss portion 203, and a tubular portion 204. The bottom cowling main body 201 preferably has a cup shape. The bottom cowling main body 201 includes an inner surface 201R. The first boss portion 202 is erected on the inner surface 201R. The first boss portion 202 includes a concave portion 202*a* recessed from the upper end surface thereof. The first convex portion 107 is preferably press-fitted, for example, to the concave portion 202*a*. Accordingly, the first convex portion 107 is fixed to the first boss portion 202. The second boss portion 203 is erected on the inner surface 201R. The second boss portion 203 includes a concave portion 203*a* recessed from the upper end surface thereof. The second convex portion 111 is inserted into the concave portion 203*a*. Accordingly, the second convex portion 111 is fixed to the second boss portion 203. The tubular portion 204 is erected on the inner surface 201R. The tubular portion 204 is disposed between the first boss portion 202 and the second boss portion 203.

The first coupling mechanism 23 includes a first lock portion 150 and a second lock portion 250. The first lock portion 150 is attached to the top cowling portion 21. The second lock portion 250 is attached to the bottom cowling portion 22. The first lock portion 150 is locked to the second lock portion 250.

The first lock portion 150 includes a sheet metal portion 151, a rotary portion 152, a contact plate 153, and a pair of bolts 154. The sheet metal portion 151 is attached to the support portion 102 of the top cowling portion 21. The upper end of the sheet metal portion 151 contacts the attachment surface 102S of the support portion 102. The sheet metal portion 151 is disposed along the inner surface 101R of the top cowling main body 101. The rotary portion 152 is rotatably attached to the sheet metal portion 151. The axis of the rotary portion 152 extends in the horizontal or substantially horizontal direction. The contact plate 153 is attached to the support portion 102 of the top cowling portion 21. The contact plate 153 preferably has a plate shape. The contact plate 153 is contacted to the opposite surface 102T of the support portion 102. The pair of bolts 154 secure the sheet metal portion 151 and the contact plate 153 together to the support portion 102.

The second lock portion 250 includes a movable plate 251, a shaft portion 252, and an urging portion 253. The movable plate 251 is disposed on the tubular portion 204 of the bottom cowling portion 22. The movable plate 251 is supported by the shaft portion 252 so as to be rotatable along a horizontal plane. The shaft portion 252 is inserted through the tubular portion 204. The lower end of the shaft portion 252 is fixed to the first lock lever 23*a* (see FIG. 1). The shaft portion 252 is thus turned together with the first lock lever 23*a*. When the first lock lever 23*a* is turned so as to be pushed into the first recess 22*a* (see FIG. 1), the movable plate 251 is moved on the rotary portion 152 while being pressed onto the rotary portion 152. The urging portion 253 urges the movable plate 251 so as to prevent the movable plate 251 from being unlocked from the rotary portion 152. Thus, the first lock portion 150 is locked to the second lock portion 250.

Figure 4:
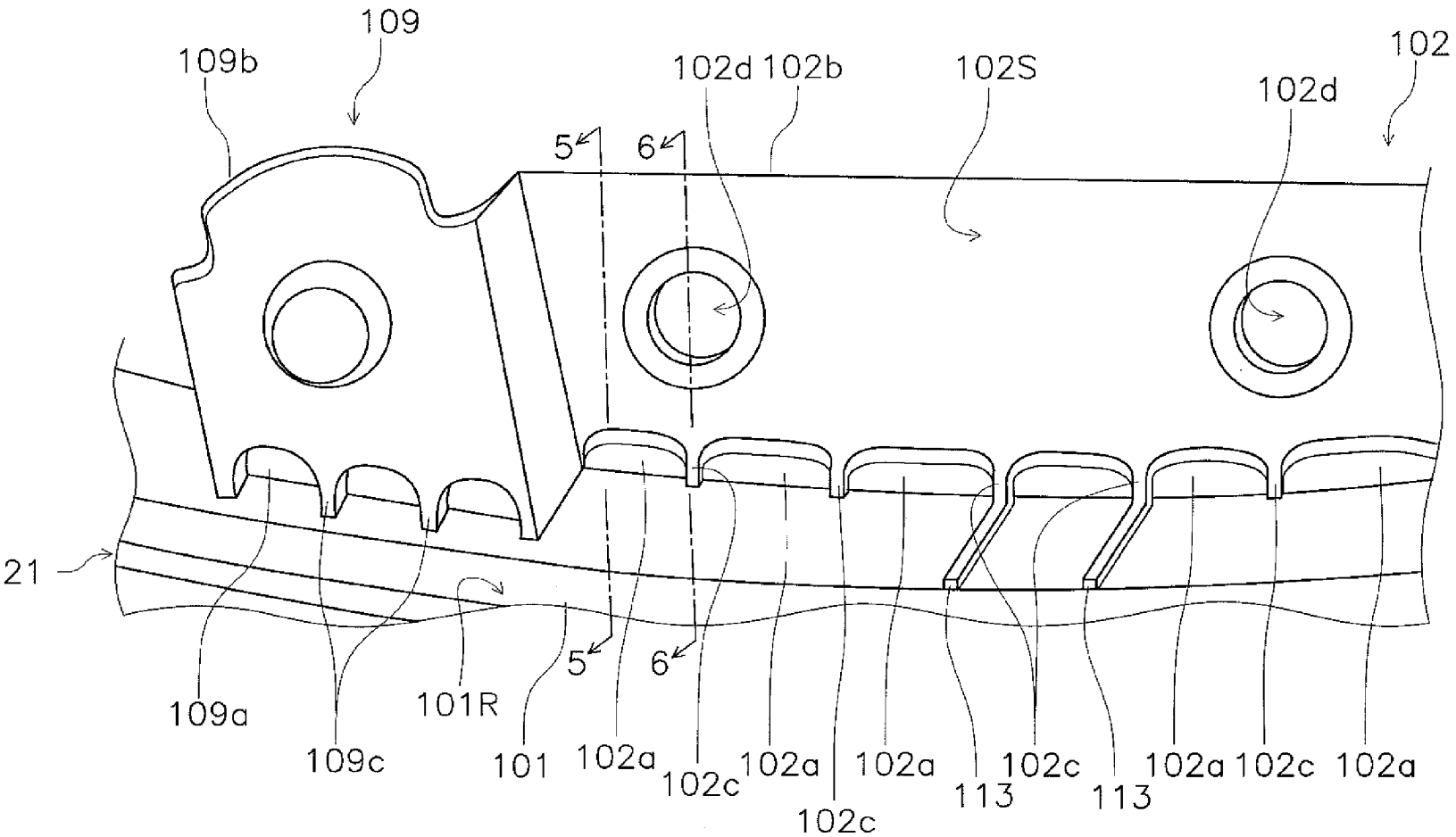
FIG. 4 is a perspective view of a support portion of a top cowling portion and the periphery thereof.
Figure 5:
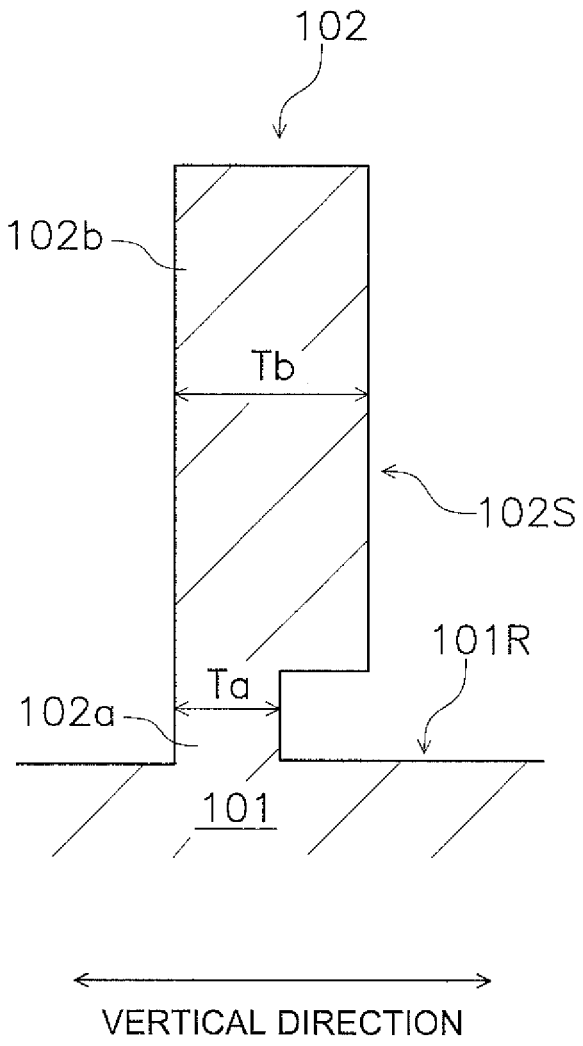
FIG. 5 is a cross-sectional view of FIG. 4 taken along a line 5-5.
Figure 6:
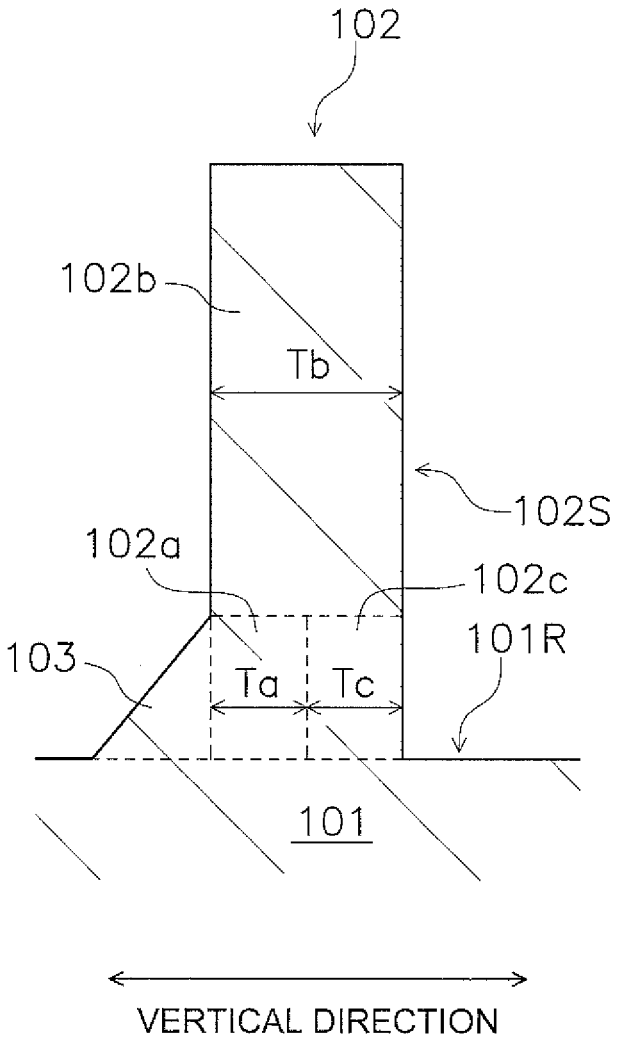
FIG. 6 is a cross-sectional view of FIG. 4 taken along a line 6-6.

FIG. 4 is a perspective view of the support portion 102 of the top cowling portion 21 and the periphery thereof. FIG. 4 illustrates a condition in which the first lock portion 150 and the second convex portion 111 are detached. FIG. 5 is a cross-sectional view of FIG. 4 taken along a line 5-5. FIG. 6 is a cross-sectional view of FIG. 4 taken along a line 6-6.

As illustrated in FIG. 4, the support portion 102 includes a small thickness section 102*a* and a large thickness section 102*b*. The small thickness section 102*a* is erected on the inner surface 101R of the top cowling main body 101. In other words, the small thickness section 102*a* is directly connected with the inner surface 101R. The small thickness section 102*a* preferably has a thin plate shape. The large thickness section 102*b* is continuous with the small thickness section 102*a*. The large thickness section 102*b* is preferably integral with the small thickness section 102*a*. The large thickness section 102*b* directly supports the sheet metal portion 151 of the first lock portion 150. In other words, the large thickness section 102*b* defines the attachment surface 102S to which the sheet metal portion 151 contacts. The large thickness section 102*b* includes a pair of insertion-through holes 102*d* through which the pair of bolts 154 are inserted. The large thickness section 102*b* includes a plurality of ribs 102*c*. The ribs 102*c* are erected on the inner surface 101R. The ribs 102*c* are directly connected with the inner surface 101R.

As illustrated in FIG. 5, the thickness (Tb) of the large thickness section 102*b* is greater than the thickness (Ta) of the small thickness section 102*a* in a direction perpendicular to the attachment surface 102S (hereinafter referred to as "a vertical direction"). Thus, in the support portion 102, a section to be joined to the top cowling main body 101 is thin, whereas a section that supports the first lock portion 150 is thick. The thickness Ta of the small thickness section 102*a* is preferably arbitrarily set as long as the small thickness section 102*a* can support the large thickness section 102*b* while dents attributed to molding shrinkage is unlikely to be produced in the top cowling main body 101. The thickness Tb of the large thickness section 102*b* is preferably arbitrarily set as long as the large thickness section 102*b* supports the first lock portion 150.

As illustrated in FIG. 6, the ribs 102*c* are integral with the top cowling main body 101, the small thickness section 102*a*, and the large thickness section 102*b*, respectively. The ribs 102*c* are provided on the opposite side of the rib portions 103 through the small thickness section 102*a*. However, the arrangement of the ribs 102*c* is preferably arbitrarily designed. In the vertical direction, the thickness Tb of the large thickness section 102*b* is approximately equal to the sum of the thickness Ta of the small thickness section 102*a* and the thickness (Tc) of the respective ribs 102*c*. It should be noted that the thickness Tc of the respective ribs 102*c* is preferably arbitrarily set. Further, the ribs 102*c* may protrude or be recessed from the large thickness section 102*b*.

It should be noted that, as illustrated in FIG. 4, the top cowling portion 21 includes a pair of rib portions 113. The rib portions 113 are erected on the inner surface 101R. The rib portions 113 are preferably integral with the top cowling main body 101. The rib portions 113 are disposed between the top cowling main body 101 and the sheet metal portion 151 (see FIG. 2). The rib portions 113 are preferably spaced away from the sheet metal portion 151. In other words, a clearance is provided between the rib portions 113 and the sheet metal portion 151. When locking the first lock portion 150 to the second lock portion 250, the sheet metal portion 151 contacts the rib portions 113 when the support portion 102 is downwardly deflected.

On the other hand, similarly to the support portion 102, the second base portion 109 includes a small thickness section 109*a*, a large thickness section 109*b*, and ribs 109*c* as illustrated in FIG. 4. The small thickness section 109*a*, the large thickness section 109*b*, and the ribs 109*c* are preferably structurally similar to the small thickness section 102*a*, the large thickness section 102*b*, and the ribs 102*c* of the support portion 102.

Explanation will be hereinafter made for an air duct configured to introduce intake air to be supplied to the engine 51.

Figure 7:
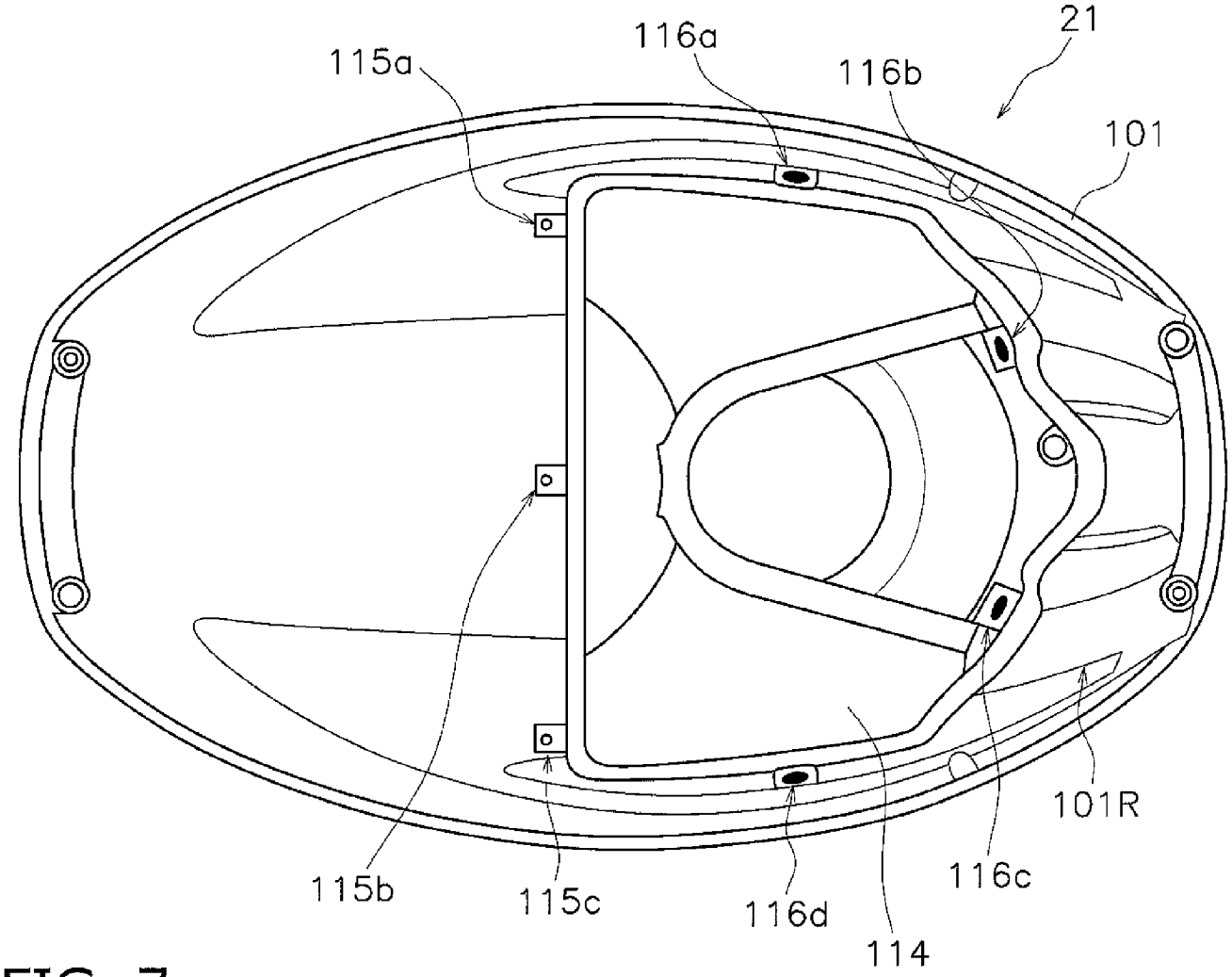
FIG. 7 is a plan view of the top cowling portion as seen from bottom.

FIG. 7 is a plan view of the top cowling portion 21 as seen from the bottom. The top cowling portion 21 includes an air duct portion 114. An air duct is arranged between the air duct portion 114 and the inner surface 101R. External air is introduced to the engine 51 through the air duct arranged between the top cowling main body 101 and the air duct portion 114.

The air duct portion 114 is connected to the top cowling main body 101 at first to third screwed portions 115*a* to 115*c* and first to fourth welded portions 116*a* to 116*d*. The air duct portion 114 is screwed to the top cowling main body 101 at the first to third screwed portions 115*a* to 115*c*. On the other hand, the air duct portion 114 is welded (so-called, heat-staked) to the top cowling main body 101 at the first to fourth welded portions 116*a* to 116*d*.

Figures 8A, 8B, 8C:
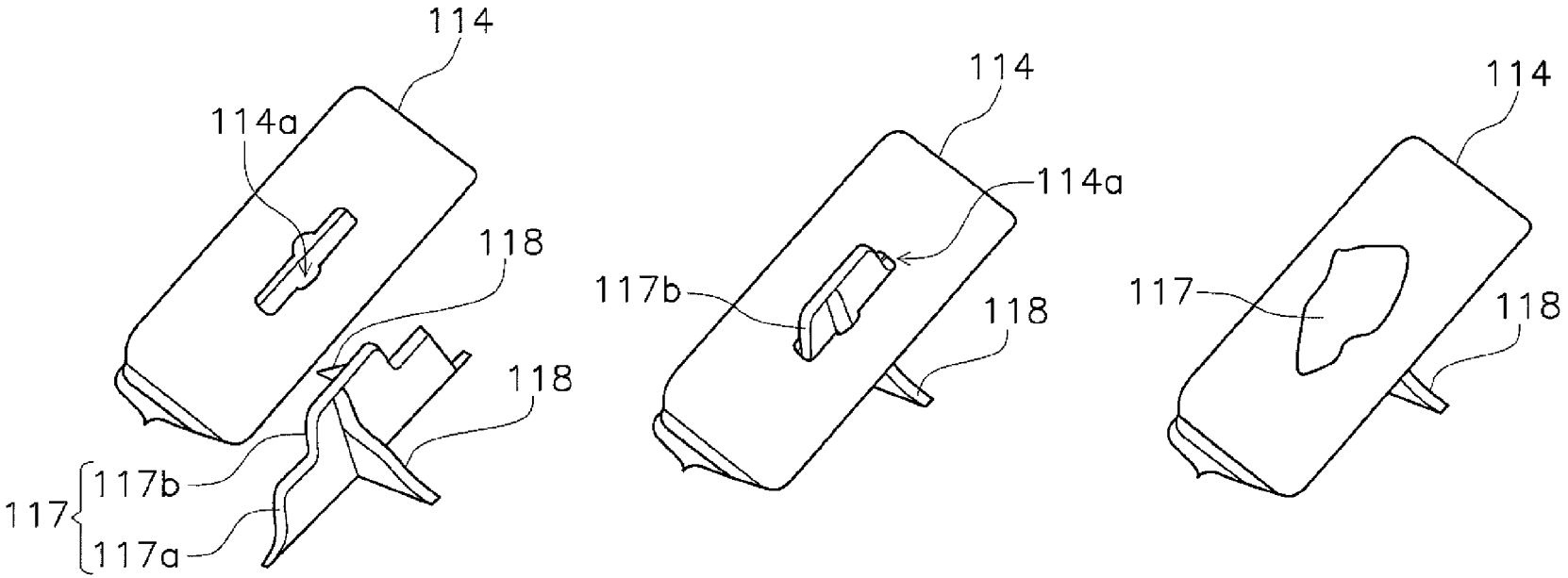
FIG. 8A is a diagram for explaining a method of forming a weld portion.
FIG. 8B is a diagram for explaining a method of forming a weld portion.
FIG. 8C is a diagram for explaining a method of forming a weld portion.

FIGS. 8A to 8C are diagrams for explaining a method of forming each of the first to fourth welded portions 116*a* to 116*d*.

As illustrated in FIG. 8A, plate-shaped fixing portions 117 are erected on the inner surface 101R of the top cowling main body 101. The thickness of the respective fixing portions 117 is preferably arbitrarily set as long as a dents attributed to molding shrinkage is unlikely to be produced in the top cowling main body 101. Each fixing portion 117 includes a lower section 117*a* and an upper section 117*b*. The lower section 117*a* is directly connected with the inner surface 101R. The upper section 117*b* is disposed on the lower section 117*a*. The upper section 117*b* is tapered such that the width thereof is gradually reduced with an increasing distance away from the inner surface 101R. Each fixing portion 117 is supported by a pair of rib portions 118 from both sides thereof. The rib portions 118 preferably have a plate shape and are erected on the inner surface 101R. The rib portions 118 are connected to the lower section 117*a* of the fixing portion 117. The thickness of the respective rib portions 118 is preferably arbitrarily set as long as dents attributed to molding shrinkage are unlikely to be produced in the top cowling main body 101. The air duct portion 114 includes insertion holes 114*a* in which the fixing portions 117 are respectively inserted.

Firstly, as illustrated in FIG. 8B, the upper section 117*b* of each fixing portion 117 is inserted into the corresponding insertion hole 114*a* of the air duct portion 114. The upper section 117*b* is herein tapered, and therefore, the upper section 117*b* is easily inserted into the insertion hole 114*a*.

Next, as illustrated in FIG. 8C, each fixing portion 117 is welded to the corresponding insertion hole 114*a* by melting the upper section 117*b* by heat. Accordingly, the air duct portion 114 is fixed to the respective fixing portions 117. The first to fourth welded portions 116*a* to 116*d* preferably are respectively formed by the method described above.

The boat propulsion device 1 according to the present preferred embodiment preferably includes the following features.

The top cowling portion 21 (an exemplary first cowling portion) includes the top cowling main body 101 (an exemplary cowling main body) and the support portion 102. The support portion 102 is erected on the inner surface 101R of the top cowling main body 101, and supports the first lock portion 150. The support portion 102 includes the small thickness section 102*a* and the large thickness section 102*b*. The small thickness section 102*a* is connected with the inner surface 101R. The large thickness section 102*b* is continuous with the small thickness section 102*a*. The large thickness section 102*b* includes the attachment surface 102S to which the first lock portion 150 is attached. The thickness Tb of the large thickness section 102*b* is greater than the thickness Ta of the small thickness section 102*a* in the direction perpendicular to the attachment surface 102S. Thus, in the support portion 102, a section to be joined to the top cowling main body 101 is thin. It is thus possible to prevent dents attributed to molding shrinkage from being produced in the top cowling main body 101. On the other hand, in the support portion 102, a section configured to support the first lock portion 150 is thick. It is thus possible to enhance the strength of the large thickness section 102*b* configured to support the first lock portion 150.

The large thickness section 102*b* includes the ribs 102*c* (exemplary first ribs) connected with the inner surface 101R. Therefore, it is possible to enhance the strength of the small thickness section 102*a* configured to support the large thickness section 102*b*.

The top cowling portion 21 includes the rib portions 113 (exemplary second ribs). The rib portions 113 are erected on the inner surface 101R, while being disposed between the top cowling main body 101 and the sheet metal portion 151. Therefore, when locking the first lock portion 150 to the second lock portion 250, the sheet metal portion 151 contacts the pair of rib portions 113 when the support portion 102 is downwardly deflected. Deflection of the support portion 102 is thus reduced. Thus, the sheet metal portion 151 and the rotary portion 152 of the first lock portion 150 are prevented from moving with respect to the movable plate 251. As a result, the first lock portion 150 is reliably locked to the second lock portion 250.

The top cowling portion 21 includes the first base portion 104, the reinforcement portion 105, and the first convex portion 107. The first convex portion 107 is preferably press-fitted to the first boss portion 202 of the bottom cowling portion 22 (an exemplary second cowling portion). The first convex portion 107 is attached to the first base portion 104. The reinforcement portion 105 is coupled to the support portion 102 and the first base portion 104. Therefore, the support portion 102 is securely supported by the reinforcement portion 105. Deflection of the support portion 102 is thus reduced when locking the first lock portion 150 to the second lock portion 250. Thus, the sheet metal portion 151 and the rotary portion 152 of the first lock portion 150 are prevented from moving with respect to the movable plate 251. As a result, the first lock portion 150 is reliably locked to the second lock portion 250.

The top cowling portion 21 includes the rib portion 108 (an exemplary third rib) extending from the first base portion 104 to the opposite side of the first convex portion 107. The height of the rib portion 108 is gradually reduced with an increasing distance away from the first base portion 104. Therefore, the first base portion 104 is more securely supported by the rib portion 108, while it is possible to prevent a harness and electric components contained in the engine unit 5 from getting stuck with the rib portion 108.

The top cowling portion 21 includes the fixing portions 117 to which the air duct portion 114 is fixed. The fixing portions 117 are erected on the inner surface 101R, and preferably have a plate shape. Therefore, the fixing portions 117 are easily provided with a small thickness. It is thus possible to further prevent dents attributed to molding shrinkage from being produced in the top cowling main body 101.

The fixing portions 117 are welded to the insertion holes 114*a* of the air duct portion 114. Therefore, the air duct portion 114 is easily, conveniently and securely connected to the fixing portions 117.

The top cowling portion 21 includes the rib portions 118 (exemplary fourth ribs) to be coupled to the fixing portions 117. The rib portions 118 are erected on the inner surface 101R, and preferably have a plate shape. Therefore, the rib portions 118 are provided with a small thickness. It is thus possible to further prevent dents attributed to molding shrinkage from being produced in the top cowling main body 101.

Preferred embodiments of the present invention have been explained above. However, the present invention is not limited to the preferred embodiments described above. A variety of changes may be herein made without departing from the scope of the present invention.

In the preferred embodiments described above, the top cowling portion 21 is preferably made of resin, whereas the bottom cowling portion 22 is preferably made of metal. However, the material of the top cowling portion 21 and that of the bottom cowling portion 22 are not limited to the above. Any suitable material or materials may be used as long as at least either of the top cowling portion 21 and the bottom cowling portion 22 is made of resin. When the bottom cowling portion 22 is made of resin, it is required to define the support portion 102 in the bottom cowling portion 22 and attach the first lock portion 150 to the support portion 102 whereas it is required to attach the second lock portion 250 to the top cowling portion 21.

In the preferred embodiments described above, the support portion 102 is preferably disposed along the horizontal or substantially horizontal direction. However, the support portion 102 may be slanted with respect to the horizontal direction.

In the preferred embodiments described above, a variety of ribs are preferably provided. However, these ribs may not be provided.

In the preferred embodiments described above, the term "locked" means a condition that a first member and a second member are interlocked or fixed with each other. Therefore, the shape of the first lock portion 150 and that of the second lock portion 250 are not limited to those illustrated in the drawings. The first lock portion 150 and the second lock portion 250 may be arbitrarily shaped as long as the first lock portion 150 may be locked to the second lock portion 250.

In the preferred embodiments described above, the term "urged" means either a condition that a first member is pressed onto a second member or a condition that the first member is pulled toward the second member. Therefore, the shape of the urging portion 253 is not limited to that illustrated in the drawings. An arbitrary member may be used as the urging portion 253, as long as such a member is configured to press or pull the movable plate 251 in order to prevent the movable plate 251 from being unlocked from the rotary portion 152.

In the preferred embodiments described above, the term "contacted" means a condition that a first member directly makes contact with a second member. Therefore, the shape of the contact plate 153 is not limited to that illustrated in the drawings. The contact plate 153 may be arbitrarily shaped as long as it directly contacts the opposite surface 102T of the support portion 102.

In the preferred embodiments described above, the expression "erected" means a condition that a first member, having a plate or rod shape, is mounted and/or raised on the outer surface of a second member. Therefore, the shape of the small thickness section 102*a* is not limited to that illustrated in the drawings. The small thickness section 102*a* may be arbitrarily shaped as long as it is raised on the inner surface 101R.

In the preferred embodiments described above, the term "rotated" means a condition that a first member is configured to freely move about a predetermined axis with respect to a second member. Therefore, the shape of the rotary portion 152 is not limited to that illustrated in the drawings. The rotary portion 152 may be arbitrarily shaped as long as it is configured to freely move about a predetermined axis with respect to the sheet metal portion 151.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat propulsion device comprising:

an engine including a crankshaft extending in an up-and-down direction; and a cowling accommodating the engine; wherein the cowling includes a first cowling portion made of resin, a second cowling, and a coupling mechanism configured to couple the first cowling portion to the second cowling portion;

the coupling mechanism includes a first lock portion and a second lock portion, the first lock portion is attached to the first cowling portion, and the second lock portion is attached to the second cowling portion and locks with the first lock portion;

the first cowling portion includes a cowling main body and a support portion, the support portion has a plate shape, the support portion is erected on an inner surface of the cowling main body, and the support portion supports the first lock portion;

the support portion includes a small thickness section and a large thickness section, the small thickness section is connected with the inner surface, the large thickness section includes an attachment surface to which the first lock portion is attached, and the large thickness section is continuous with the small thickness section;

a thickness of the large thickness section is greater than a thickness of the small thickness section in a direction perpendicular or substantially perpendicular to the attachment surface; and the large thickness section includes a rib connected with the inner surface.

2. The boat propulsion device according to claim 1, wherein the first lock portion includes a sheet metal portion attached to the attachment surface of the support portion and extending along the inner surface; and the first cowling portion includes a rib erected on the inner surface and disposed between the sheet metal portion and the cowling main body.

3. The boat propulsion device according to claim 1, wherein the first cowling portion includes a base portion disposed on the inner surface, a convex portion attached to the base portion, and a reinforcement portion disposed on the inner surface;

the second cowling portion includes a boss portion into which the convex portion is inserted; and the reinforcement portion is coupled to the support portion and the base portion.

4. The boat propulsion device according to claim 3, wherein the first cowling portion includes a rib erected on the inner surface and extending from the base portion to an opposite side of the convex portion; and a height of the rib of the first cowling portion is reduced as a distance from the base portion increases in the direction perpendicular or substantially perpendicular to the inner surface.

5. A boat propulsion device comprising:

an engine including a crankshaft extending in an up-and-down direction; and a cowling accommodating the engine; wherein the cowling includes a first cowling portion made of resin, a second cowling, and a coupling mechanism configured to couple the first cowling portion to the second cowling portion;

the coupling mechanism includes a first lock portion and a second lock portion, the first lock portion is attached to the first cowling portion, and the second lock portion is attached to the second cowling portion and locks with the first lock portion;

the first cowling portion includes a cowling main body and a support portion, the support portion has a plate shape, the support portion is erected on an inner surface of the cowling main body, and the support portion supports the first lock portion;

the support portion includes a small thickness section and a large thickness section, the small thickness section is connected with the inner surface, the large thickness section includes an attachment surface to which the first lock portion is attached, and the large thickness section is continuous with the small thickness section;

a thickness of the large thickness section is greater than a thickness of the small thickness section in a direction perpendicular or substantially perpendicular to the attachment surface;

the boat propulsion device further includes an air duct portion disposed within the first cowling portion, the air duct portion configured to define an air duct between the air duct portion and the inner surface;

the first cowling portion includes a fixing portion to which the air duct portion is fixed; and the fixing portion has a plate shape and is erected on the inner surface.

6. The boat propulsion device according to claim 5, wherein the air duct portion includes an insertion hole into which the fixing portion is inserted, and the fixing portion is welded to the insertion hole.

7. The boat propulsion device recited in claim 5, wherein the first cowling portion includes a rib coupled to the fixing portion, and the rib has a plate shape and is erected on the inner surface.

* * * * *